US009212834B2

(12) United States Patent
Parsonnet et al.

(10) Patent No.: US 9,212,834 B2
(45) Date of Patent: Dec. 15, 2015

(54) SYSTEM AND METHOD FOR LIQUID-SUCTION HEAT EXCHANGE THERMAL ENERGY STORAGE

(75) Inventors: Brian Parsonnet, Fort Collins, CO (US); Robert R. Willis, Jr., Fort Collins, CO (US); Dean L. Wiersma, Fort Collins, CO (US)

(73) Assignee: GREENER-ICE SPV, L.L.C., Scottsdale, AZ (US)

( * ) Notice: Subject to any disclaimer, the term of this patent is extended or adjusted under 35 U.S.C. 154(b) by 29 days.

(21) Appl. No.: 13/524,727

(22) Filed: Jun. 15, 2012

(65) Prior Publication Data

US 2013/0145780 A1 Jun. 13, 2013

Related U.S. Application Data

(60) Provisional application No. 61/498,340, filed on Jun. 17, 2011.

(51) Int. Cl.

| | |
|---|---|
| ***F25B 1/00*** | (2006.01) |
| ***F25B 40/00*** | (2006.01) |
| ***F25D 16/00*** | (2006.01) |

(52) U.S. Cl.

CPC . *F25B 1/00* (2013.01); *F25B 40/00* (2013.01); *F25D 16/00* (2013.01); *F25B 2400/24* (2013.01)

(58) Field of Classification Search

CPC ..... F25B 1/00; F25B 40/00; F25B 2400/00; F25B 2400/24; F25D 16/00

USPC ..... 62/115, 278, 434, 333, 513, 56

See application file for complete search history.

(56) References Cited

U.S. PATENT DOCUMENTS

| | | | |
|---|---|---|---|
| 1,969,187 | A | 8/1934 | Schutt |
| 2,512,576 | A | 6/1950 | Cross |
| 2,661,576 | A | 12/1953 | Gartner |

(Continued)

FOREIGN PATENT DOCUMENTS

| | | | |
|---|---|---|---|
| DE | 100 57 834 | A1 | 9/1957 |
| DE | 298 23 175 | U1 | 7/1999 |

(Continued)

OTHER PUBLICATIONS

U.S. Appl. No. 11/138,762, Non-Final Office Action, pp. 1-15.
U.S. Appl. No. 11/138,762, Final Office Action, pp. 1-6.
U.S. Appl. No. 11/284,533, Non Final Office Action, pp. 1-11.
International Search Report for PCT/US2005/042409, International Searching Authority, Oct. 5, 2006, pp. 1-17.

(Continued)

*Primary Examiner* — Mohammad M Ali
(74) *Attorney, Agent, or Firm* — Paul M. Thompson; Cochran Freund & Young LLC

(57) ABSTRACT

Disclosed is a method and device for a thermal energy storage liquid-suction heat exchanger (TES-LSHX) for air conditioning and refrigeration (AC/R) applications. The disclosed embodiments allow energy to be stored and aggregated over one period of time, and dispatched at a later period of time, to improve AC/R system efficiency during desired conditions. Not only are the benefits of LSHX stored and aggregated for later use, but when dispatched, the discharge rate can exceed the charge rate thereby further enhancing the benefit of demand reduction to utilities. The disclosed embodiments allow great flexibility and can be incorporated into OEM AC/R system designs, and/or bundled with condensing units or evaporator coils. These TES-LSHX systems can be retrofit with existing systems by installing the product at any point along the existing AC/R system's line set.

25 Claims, 4 Drawing Sheets

(56) References Cited

U.S. PATENT DOCUMENTS

| | | | | |
|---|---|---|---|---|
| 2,737,027 | A | 3/1956 | Kleist | |
| 3,156,101 | A | 11/1964 | McGuffey | |
| 3,746,084 | A | 7/1973 | Ostbo | |
| 4,073,306 | A | 2/1978 | Neyer | |
| 4,129,014 | A | 12/1978 | Chubb | |
| 4,176,525 | A | 12/1979 | Tucker et al. | |
| 4,274,849 | A | 6/1981 | Garier et al. | |
| 4,280,335 | A | 7/1981 | Perez et al. | |
| 4,291,757 | A | 9/1981 | Redden | |
| 4,294,078 | A | 10/1981 | MacCracken | |
| 4,313,309 | A | 2/1982 | Lehman, Jr. | |
| 4,403,645 | A | 9/1983 | MacCracken | |
| 4,484,449 | A | 11/1984 | Muench | |
| 4,484,617 | A | 11/1984 | Sizmann | |
| 4,565,069 | A | 1/1986 | MacCracken | |
| 4,608,836 | A | 9/1986 | MacCracken et al. | |
| 4,609,036 | A | 9/1986 | Schrader | |
| 4,619,317 | A | 10/1986 | Disselbeck et al. | |
| 4,656,839 | A | 4/1987 | Cross et al. | |
| 4,702,086 | A * | 10/1987 | Nunn et al. | 62/113 |
| 4,735,064 | A | 4/1988 | Fischer | |
| 4,745,767 | A | 5/1988 | Ohya et al. | |
| 4,893,476 | A | 1/1990 | Bos et al. | |
| 4,916,916 | A | 4/1990 | Fischer | |
| 4,921,100 | A | 5/1990 | Krause | |
| 4,940,079 | A | 7/1990 | Best et al. | |
| 4,964,279 | A | 10/1990 | Osborne | |
| 5,005,368 | A | 4/1991 | MacCracken et al. | |
| 5,036,904 | A | 8/1991 | Kanda et al. | |
| 5,079,929 | A | 1/1992 | Alsenz | |
| 5,109,920 | A | 5/1992 | Merryfull | |
| 5,211,029 | A | 5/1993 | Uselton et al. | |
| 5,237,832 | A | 8/1993 | Alston | |
| 5,241,829 | A | 9/1993 | Irie et al. | |
| 5,255,526 | A | 10/1993 | Fischer | |
| 5,307,642 | A | 5/1994 | Dean | |
| 5,323,618 | A | 6/1994 | Yoshida et al. | |
| 5,335,508 | A | 8/1994 | Tippmann | |
| 5,366,153 | A | 11/1994 | Swenson | |
| 5,383,339 | A | 1/1995 | McCloskey et al. | |
| 5,423,378 | A | 6/1995 | Dillenbeck et al. | |
| 5,467,812 | A | 11/1995 | Dean et al. | |
| 5,598,716 | A | 2/1997 | Tanaka et al. | |
| 5,598,720 | A | 2/1997 | MacCracken et al. | |
| 5,622,055 | A * | 4/1997 | Mei et al. | 62/113 |
| 5,647,225 | A | 7/1997 | Fischer et al. | |
| 5,678,626 | A | 10/1997 | Gilles | |
| 5,682,752 | A | 11/1997 | Dean | |
| 5,715,202 | A | 2/1998 | Harima | |
| 5,720,178 | A | 2/1998 | Silvetti et al. | |
| 5,740,679 | A | 4/1998 | Ueno et al. | |
| 5,755,104 | A | 5/1998 | Rafalovich et al. | |
| 5,899,091 | A | 5/1999 | Fraser, Jr. et al. | |
| 5,927,101 | A | 7/1999 | Oh | |
| 5,992,160 | A | 11/1999 | Bussjager et al. | |
| 6,112,543 | A | 9/2000 | Feuerecker et al. | |
| 6,131,398 | A | 10/2000 | Versteijnen | |
| 6,131,401 | A | 10/2000 | Ueno et al. | |
| 6,148,634 | A | 11/2000 | Sherwood | |
| 6,158,499 | A | 12/2000 | Rhodes et al. | |
| 6,212,898 | B1 | 4/2001 | Ueno et al. | |
| 6,237,358 | B1 | 5/2001 | Kondo et al. | |
| 6,247,522 | B1 | 6/2001 | Kaplan et al. | |
| 6,250,098 | B1 | 6/2001 | Huang | |
| 6,260,376 | B1 | 7/2001 | Khelifa et al. | |
| 6,298,683 | B1 | 10/2001 | Kondo et al. | |
| 6,327,871 | B1 | 12/2001 | Rafalovich | |
| 6,370,908 | B1 | 4/2002 | James | |
| 6,457,325 | B1 * | 10/2002 | Vetter | 62/473 |
| 6,460,355 | B1 | 10/2002 | Trieskey | |
| 6,474,089 | B1 | 11/2002 | Chen | |
| 6,516,623 | B1 * | 2/2003 | Collier | 62/238.7 |
| D501,490 | S | 2/2005 | Kerrigan | |
| 6,895,773 | B2 | 5/2005 | Amaral | |
| 7,124,594 | B2 | 10/2006 | McRell | |
| 7,152,413 | B1 | 12/2006 | Anderson | |
| 7,162,878 | B2 | 1/2007 | Narayanamurthy et al. | |
| 7,210,308 | B2 | 5/2007 | Tanimoto et al. | |
| 7,363,772 | B2 | 4/2008 | Narayanamurthy | |
| 7,421,846 | B2 | 9/2008 | Narayanamurthy et al. | |
| 7,503,185 | B2 | 3/2009 | Narayanamurthy et al. | |
| 7,543,455 | B1 | 6/2009 | Chen | |
| 7,610,773 | B2 | 11/2009 | Rafalovich et al. | |
| 7,690,212 | B2 | 4/2010 | Narayanamurthy et al. | |
| 7,793,515 | B2 | 9/2010 | Narayanamurthy | |
| 7,836,721 | B2 | 11/2010 | Nishiwaki et al. | |
| 8,015,836 | B2 | 9/2011 | Kameyama et al. | |
| 8,397,528 | B2 * | 3/2013 | Awwad et al. | 62/225 |
| 2002/0124583 | A1 | 9/2002 | Satoh | |
| 2002/0162342 | A1 | 11/2002 | Weng et al. | |
| 2004/0007011 | A1 | 1/2004 | Tanaka | |
| 2004/0221589 | A1 | 11/2004 | Dube et al. | |
| 2005/0081557 | A1 | 4/2005 | McRell | |
| 2005/0132734 | A1 | 6/2005 | Narayanamurthy et al. | |
| 2005/0262870 | A1 | 12/2005 | Narayanamurthy et al. | |
| 2005/0279127 | A1 * | 12/2005 | Jia et al. | 62/510 |
| 2006/0042274 | A1 * | 3/2006 | Manole | 62/77 |
| 2006/0096308 | A1 * | 5/2006 | Manole | 62/277 |
| 2007/0000281 | A1 * | 1/2007 | Manole | 62/513 |
| 2007/0095087 | A1 * | 5/2007 | Wilson et al. | 62/259.2 |
| 2007/0095093 | A1 | 5/2007 | Narayanamurthy | |
| 2008/0034760 | A1 | 2/2008 | Narayanamurthy et al. | |
| 2008/0141699 | A1 | 6/2008 | Rafalovich et al. | |
| 2008/0196430 | A1 * | 8/2008 | McGill et al. | 62/228.1 |
| 2008/0223074 | A1 * | 9/2008 | Pachai et al. | 62/513 |
| 2008/0302113 | A1 * | 12/2008 | Yin et al. | 62/115 |
| 2009/0133412 | A1 | 5/2009 | Narayanamurthy et al. | |
| 2009/0301109 | A1 * | 12/2009 | Manole | 62/79 |
| 2010/0083679 | A1 * | 4/2010 | Kolstad et al. | 62/117 |
| 2010/0170286 | A1 | 7/2010 | Ghiraldi | |
| 2011/0011119 | A1 | 1/2011 | Kuehl et al. | |

FOREIGN PATENT DOCUMENTS

| | | | |
|---|---|---|---|
| DE | 198 31 127 | A1 | 3/2001 |
| DE | 1 015 019 | | 6/2002 |
| EP | 0 641 978 | B2 | 7/1998 |
| EP | 1 441 183 | A1 | 7/2004 |
| JP | 58-217133 | | 12/1983 |
| JP | 60 036835 | A | 2/1985 |
| JP | A-2000-266368 | | 1/1996 |
| JP | 8-226682 | | 9/1996 |
| JP | 10-339483 | | 12/1998 |
| JP | A-2001-296068 | | 12/1998 |
| JP | 8-14628 | | 9/2000 |
| JP | A-2000-249420 | | 10/2001 |
| WO | WO 2005/001345 | A1 | 1/2005 |
| WO | WO 2005/038367 | | 4/2005 |
| WO | WO 2005/116547 | A | 12/2005 |
| WO | WO 2006/023716 | A | 3/2006 |

OTHER PUBLICATIONS

International Search Report for PCT/US2005/018616, International Searching Authority, Oct. 10, 2005, pp. 1-14.
International Search Report for PCT/US2009/34087, International Searching Authority, pp. 1-13.
International Search Report for PCT/US2009/045427, International Searching Authority, pp. 1-11.
International Search Report for PCT/US2012/031168, International Searching Authority, pp. 1-18.
International Search Report for PCT/US2005/029535, International Searching Authority, May 12, 2005, pp. 1-12.
Notice of Allowance, U.S. Appl. No. 11/208,074, pp. 1-14.
Notice of Allowance, U.S. Appl. No. 12/100,893, pp. 1-15.
International Search Report, International Searching Authority, Sep. 13, 2012, pp. 1-17.
Non Final Office Action, U.S. Appl. No. 12/324,369, Dated Mar. 5, 2012, pp. 1-16.

* cited by examiner

SYSTEM AND METHOD FOR LIQUID-SUCTION HEAT EXCHANGE THERMAL ENERGY STORAGE

CROSS REFERENCE TO RELATED APPLICATION

This application is based upon and claims the benefit of U.S. provisional application No. 61/498,340, entitled "System and Method for Liquid-Suction Heat Exchange Thermal Energy Storage," filed Jun. 17, 2011 and the entire disclosures of which is hereby specifically incorporated by reference for all that it discloses and teaches.

BACKGROUND OF THE INVENTION

With the increasing demands on peak demand power consumption, Thermal Energy Storage (TES) has been utilized to shift air conditioning power loads to off-peak times and rates. A need exists not only for load shifting from peak to off-peak periods, but also for increases in air conditioning unit capacity and efficiency. Current air conditioning units having energy storage systems have had limited success due to several deficiencies, including reliance on water chillers that are practical only in large commercial buildings and have difficulty achieving high-efficiency.

In order to commercialize advantages of thermal energy storage in large and small commercial buildings, thermal energy storage systems must have minimal manufacturing costs, maintain maximum efficiency under varying operating conditions, have minimal implementation and operation impact and be suitable for multiple refrigeration or air conditioning applications.

Systems for providing stored thermal energy have been previously contemplated in U.S. Pat. No. 4,735,064, U.S. Pat. No. 5,225,526, both issued to Harry Fischer, U.S. Pat. No. 5,647,225 issued to Fischer et al., U.S. Pat. No. 7,162,878 issued to Narayanamurthy et al., U.S. Pat. No. 7,854,129 issued to Narayanamurthy, U.S. Pat. No. 7,503,185 issued to Narayanamurthy et al., U.S. Pat. No. 7,827,807 issued to Narayanamurthy et al., U.S. Pat. No. 7,363,772 issued to Narayanamurthy, U.S. Pat. No. 7,793,515 issued to Narayanamurthy, U.S. patent application Ser. No. 11/837,356 filed Aug. 10, 2007 by Narayanamurthy et al., application Ser. No. 12/324,369 filed Nov. 26, 2008 by Narayanamurthy et al., U.S. patent application Ser. No. 12/371,229 filed Feb. 13, 2009 by Narayanamurthy et al., U.S. patent application Ser. No. 12/473,499 filed May 28, 2009 by Narayanamurthy et al., U.S. patent application Ser. No. 12/335,871 filed Dec. 16, 2008 by Parsonnet et al. and U.S. Patent Application No. 61/470,841 filed Apr. 1, 2011 by Parsonnet et al. All of these patents and applications utilize ice storage to shift air conditioning loads from peak to off-peak electric rates to provide economic justification and are hereby incorporated by reference herein for all they teach and disclose.

SUMMARY OF THE INVENTION

An embodiment of the present invention may therefore comprise: an integrated refrigerant-based thermal energy storage and cooling system comprising: a condensing unit, the condensing unit comprising a compressor and a condenser; an expansion device connected downstream of the condensing unit; an evaporator connected downstream of the expansion device; a thermal energy storage module comprising: a thermal storage media contained therein; a liquid heat exchanger between the condenser and the expansion device, that facilitates heat transfer between a refrigerant and the thermal storage media; a suction heat exchanger between the evaporator and the compressor that facilitates heat transfer between the refrigerant and the thermal storage media; and, a first valve that facilitates flow of refrigerant from the condenser to the thermal energy storage module or the expansion device.

An embodiment of the present invention may also comprise: an integrated refrigerant-based thermal energy storage and cooling system comprising: a refrigerant loop containing a refrigerant comprising: a condensing unit, the condensing unit comprising a compressor and a condenser; an expansion device connected downstream of the condensing unit; and, an evaporator connected downstream of the expansion device; a thermal energy storage module comprising: a thermal storage media contained therein; a liquid heat exchanger; and, a suction heat exchanger; a thermal energy storage discharge loop comprising: an isolated liquid line heat exchanger in thermal communication with the liquid heat exchanger, the isolated liquid line heat exchanger in thermal communication with the refrigeration loop between the condenser and the expansion device, the discharge loop that facilitates heat transfer between the thermal storage media and the refrigerant; a first valve that facilitates thermal communication between the liquid heat exchanger and the isolated liquid line heat exchanger; a thermal energy storage suction loop comprising: an isolated suction line heat exchanger in thermal communication with the suction heat exchanger, the isolated suction line heat exchanger in thermal communication with the refrigeration loop between the evaporator and the condenser, the suction loop that facilitates heat transfer between the thermal storage media and the refrigerant; a second valve that facilitates thermal communication between the suction heat exchanger and the isolated liquid suction heat exchanger.

An embodiment of the present invention may therefore comprise: a method of providing cooling with a thermal energy storage and cooling system comprising: compressing and condensing a refrigerant with a compressor and a condenser to create a high-pressure refrigerant; during a first time period: expanding the high-pressure refrigerant with an expansion device to produce expanded refrigerant and provide load cooling with an evaporator; transferring cooling from the expanded refrigerant downstream of the evaporator to a thermal energy storage media within a thermal energy storage module via a suction heat exchanger constrained therein; and, returning the expanded refrigerant to the compressor; during a second time period: subcooling the high-pressure refrigerant downstream of the compressor with the thermal energy storage media within the thermal energy storage module via a liquid heat exchanger constrained therein; expanding the subcooled refrigerant with the expansion device to produce expanded refrigerant and provide load cooling with the evaporator; transferring cooling from the expanded refrigerant downstream of the evaporator to the thermal energy storage media via the suction heat exchanger; and, returning the expanded refrigerant to the compressor; during a third time period: subcooling the high-pressure refrigerant downstream of the compressor with the thermal energy storage media within the thermal energy storage module via the liquid heat exchanger; expanding the subcooled refrigerant with the expansion device to produce expanded refrigerant and provide load cooling with the evaporator; and, returning the expanded refrigerant to the compressor.

An embodiment of the present invention may therefore comprise: a method of providing cooling with a thermal energy storage and cooling system comprising: compressing and condensing a refrigerant with a compressor and a condenser to create a high-pressure refrigerant; during a first time period: expanding the high-pressure refrigerant with an expansion device to produce expanded refrigerant and provide load cooling with an evaporator; transferring cooling from the expanded refrigerant downstream of the evaporator to a thermal energy storage media within a thermal energy storage module via an isolated suction line heat exchanger; and, returning the expanded refrigerant to the compressor; during a second time period: subcooling the high-pressure refrigerant downstream of the condenser with the thermal energy storage media via an isolated liquid line heat exchanger; expanding the subcooled refrigerant with the expansion device to produce expanded refrigerant and provide load cooling with the evaporator; transferring cooling from the expanded refrigerant downstream of the evaporator to the thermal energy storage media via the isolated suction line heat exchanger; and, returning the expanded refrigerant to the compressor; during a third time period: subcooling the high-pressure refrigerant downstream of the condenser with the thermal energy storage media via an isolated liquid line heat exchanger; expanding the subcooled refrigerant with the expansion device to produce expanded refrigerant and provide load cooling with the evaporator; and, returning the expanded refrigerant to the compressor.

An embodiment of the present invention may also comprise: an integrated refrigerant-based thermal energy storage and cooling system comprising: a refrigerant loop containing a refrigerant comprising: a condensing unit, the condensing unit comprising a compressor and a condenser; an expansion device connected downstream of the condensing unit; and, an evaporator connected downstream of the expansion device; a thermal energy storage module comprising: a thermal storage and transfer media contained therein; a thermal energy storage discharge loop comprising: an isolated liquid line heat exchanger in thermal communication with the thermal energy storage module, the isolated liquid line heat exchanger in thermal communication with the refrigeration loop between the condenser and the expansion device, the discharge loop that facilitates heat transfer between the thermal storage and transfer media in the thermal energy storage module and the refrigerant; a first valve that facilitates thermal communication between the thermal energy storage module and the isolated liquid line heat exchanger; a thermal energy storage charge loop comprising: an isolated suction line heat exchanger in thermal communication with the thermal energy storage module, the isolated suction line heat exchanger in thermal communication with the refrigeration loop between the evaporator and the condenser, the charge loop that facilitates heat transfer between the thermal storage and transfer media in the thermal energy storage module and the refrigerant; a second valve that facilitates thermal communication between the thermal energy storage module and the isolated liquid suction heat exchanger.

DETAILED DESCRIPTION OF THE INVENTION

Figure 1:
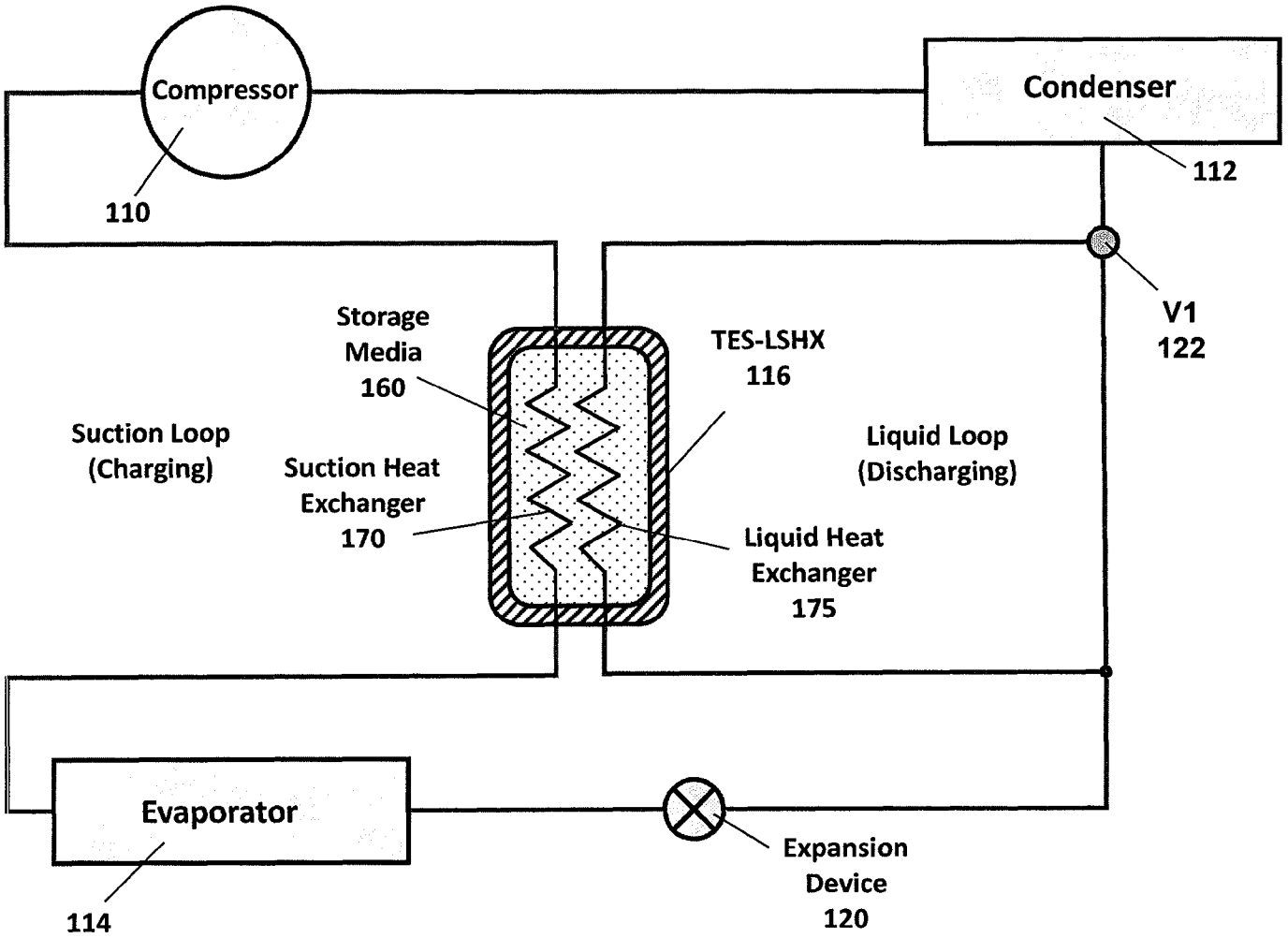
FIG. 1 schematically illustrates an embodiment of a thermal energy storage liquid-suction heat exchanger for air conditioning and refrigerant applications.

While this invention is susceptible to embodiment in many different forms, it is shown in the drawings, and will be described herein in detail, specific embodiments thereof with the understanding that the present disclosure is to be considered as an exemplification of the principles of the invention and is not to be limited to the specific embodiments described.

FIG. 1 illustrates an embodiment of a thermal energy storage liquid-suction heat exchanger (TES-LSHX) for air conditioning and refrigeration (AC/R) applications. As illustrated in FIG. 1, a variety of modes may be utilized in the system shown to provide cooling in various conventional or non-conventional air conditioning/refrigerant applications and utilized with an integrated condenser/compressor/evaporator (e.g., off-the-shelf unit or original equipment manufactured [OEM]) as either a retrofit to an existing system or a completely integrated new install. In this embodiment, three primary modes of operation are attainable with the system as shown: LSHX mode, charge mode, and discharge modes.

The TES-LSHX embodied in FIG. 1 allows the benefits of liquid-suction heat exchangers that can be stored and aggregated over one period of time, and dispatched at a later period of time, to improve AC/R system efficiency during desired conditions. As an example, many TES-LSHX systems may be deployed in a geographic region and the aggregated performance improvements dispatched to reduce peak utility system demand. Not only are the benefits of LSHX stored and aggregated for later use, but when dispatched, the discharge rate can exceed the charge rate, thereby further enhancing the benefit of demand reduction to utilities. The disclosed embodiments allow great flexibility and can be incorporated into OEM AC/R system designs, and/or bundled with condensing units or evaporator coils. These TES-LSHX systems can be retrofit with existing systems by installing the product at any point along the existing AC/R system's lineset.

FIG. 1 shows a single valve design for a direct heat exchange configuration. The direct heat exchange configuration refers to the fact that energy is transferred directly from the AC/R system's liquid and suction lines to the storage media or each other. For example, the refrigerant used in the AC/R system to provide cooling to the load, is in direct thermal communication with the storage media. The single valve design shown in FIG. 1 allows several modes of operation including LSHX, charge, and discharge. The multi-valve design shown in FIG. 2, allows additional modes of operation, including LSHX isolated (normal direct expansion AC/R operation) and subcooling only discharge.

When operating in charge mode, the system of FIG. 1 activates all basic AC/R components, including the compressor 110, condenser 112, evaporator expansion device 120, and the evaporator 114. In addition, the TES-LSHX 116 rejects heat from the storage media 160 to the cold vapor return line between the evaporator and compressor. Valve V1 122 directs warm liquid refrigerant leaving the condenser 112, after being compressed by the compressor 110, to the expansion device 120, bypassing the TES-LSHX 116. The warm liquid is expanded by the evaporator expansion device 120 to generate a cold mixed phase refrigerant that absorbs heat and is vaporized in the evaporator 114 to provide cooling. The cold vapor refrigerant leaves the evaporator 114 and enters the TES-LSHX 116 where it transfers cooling to (absorbs heat from) the storage media 160 through the suction heat exchanger 170, resulting in increased superheat of the cold vapor refrigerant prior to entering the compressor 110. In this mode, there is a net energy removal from the storage media 160.

In the LSHX mode of the system of FIG. 1, all basic AC/R components are active including the compressor 110, condenser 112, evaporator expansion device 120, and the evaporator 114. In this embodiment, the TES-LSHX 116 transfers energy from the warm liquid supply line to the cold vapor suction line through direct heat exchange in the liquid heat exchanger 175 and/or via the storage media 160. Valve V1 122 in this example, directs warm liquid refrigerant leaving the condenser 112, after being compressed by the compressor 110, to the TES-LSHX 116 (storage module) where it rejects heat to the storage media 160 and/or the cold vapor refrigerant leaving the evaporator 114 via the suction heat exchanger 170. This rejection of heat to the storage media 160, results in increased subcooling of the warm liquid prior to entering the evaporator expansion device 120. The warm liquid is expanded by the evaporator expansion device 120 to generate a cold mixed phase refrigerant that absorbs heat and is vaporized in the evaporator 114 to provide cooling. The cold vapor refrigerant leaves the evaporator 114 and enters the TES-LSHX 116 where it transfers cooling to (absorbs heat from) the storage media 160 and/or the warm liquid refrigerant leaving valve V1 122 via the liquid heat exchanger 175. This results in increased superheating of the cold vapor refrigerant prior to entering the compressor 110. In this mode, the TES-LSHX 116 acts as a traditional LSHX (i.e., there is zero or a neutral net energy transfer to the storage media 160).

In the discharge mode of the system of FIG. 1, all basic AC/R components are active including the compressor 110, condenser 112, evaporator expansion device 120, and the evaporator 114. In addition, the TES-LSHX 116 (storage module) transfers energy from the warm liquid supply line to the storage media 160 and the cold vapor suction line through direct heat exchange in the LSHX 175. In this mode, valve V1 122 directs warm liquid refrigerant leaving the condenser 112, after being compressed by the compressor 110, to the TES-LSHX 116, where it rejects heat to the storage media 160 and/or the cold vapor refrigerant leaving the evaporator 114 via the suction heat exchanger 170. This results in increased subcooling of the warm liquid prior to entering the evaporator expansion device 120. This warm liquid is expanded by the evaporator expansion device 120 to generate a cold mixed phase refrigerant that absorbs heat and is vaporized in the evaporator 114 to provide cooling. The cold vapor refrigerant leaves the evaporator 114 and enters the TES-LSHX 116 where it transfers cooling to (absorbs heat from) the storage media 160 and/or the warm liquid refrigerant leaving valve V1 122 via the suction heat exchanger 170, resulting in increased superheat of the cold vapor refrigerant prior to entering the compressor 110. In this mode, there is a net energy addition to the storage media 160.

Figure 2:
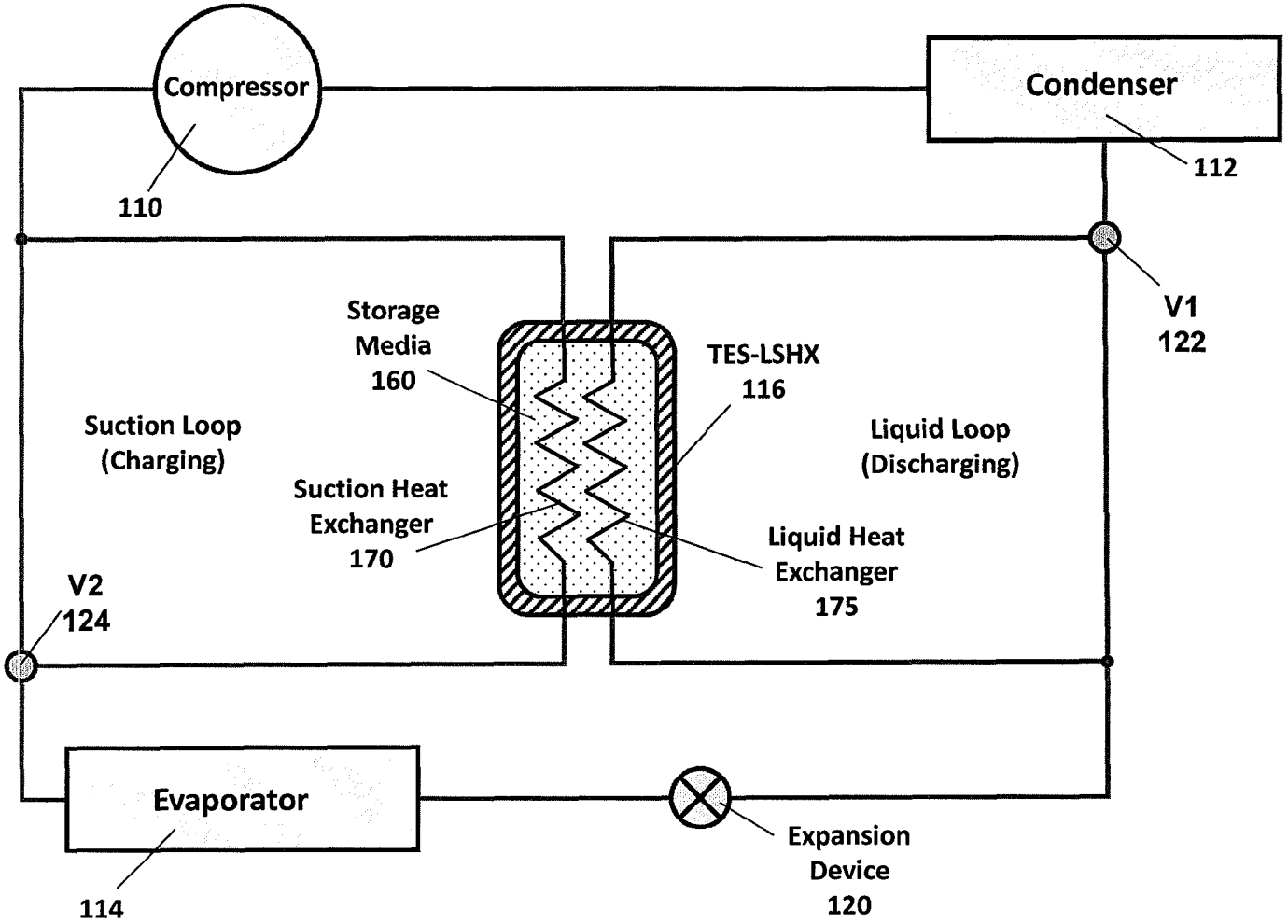
FIG. 2 schematically illustrates another embodiment of a thermal energy storage liquid-suction heat exchanger.

FIG. 2 illustrates another embodiment of a TES-LSHX for AC/R applications. As illustrated in FIG. 2, the addition of a second valve V2 124 provides additional modes that may be utilized in the system as shown, to provide cooling in various conventional or non-conventional AC/R applications and utilized with an integrated condenser/compressor/evaporator as either a retrofit to an existing system or a completely integrated new install. In this embodiment, five primary modes of operation are attainable with the system as shown: LSHX mode, charge mode, discharge mode, LSHX isolated mode and subcooling only discharge mode.

In charge mode of the system of FIG. 2, all basic AC/R components are active including the compressor 110, condenser 112, evaporator expansion device 120, and the evaporator 114. In addition, the TES-LSHX 116 rejects heat from the storage media 160 to the cold vapor return line. Valve V1 122 directs warm liquid refrigerant leaving the condenser 112, after being compressed by the compressor 110, to the evaporator expansion device 120, bypassing the TES-LSHX 116. The warm liquid is expanded by the evaporator expansion device 120 to generate a cold mixed phase refrigerant that absorbs heat and is vaporized in the evaporator 114 to provide cooling. The cold vapor refrigerant leaves the evaporator 114 and is directed by valve V2 124 to the TES-LSHX 116 where it transfers cooling to (absorbs heat from) the storage media 160 via the suction heat exchanger 170, resulting in increased superheat of the cold vapor refrigerant prior to entering the compressor 110. In this mode, there is a net energy removal from the storage media 160.

The system of FIG. 2, when in LSHX mode, operates with all basic AC/R components active, including the compressor 110, condenser 112, evaporator expansion device 120, and the evaporator 114. In addition, the TES-LSHX 116 transfers energy from the warm liquid supply line to the cold vapor suction line through direct heat exchange in the liquid heat exchanger 175 and/or via the storage media 160. Valve V1 122 directs warm liquid refrigerant leaving the condenser 112, after being compressed by the compressor 110, to the TES-LSHX 116 (storage module). Here, the refrigerant rejects heat to the storage media 160 and/or the cold vapor refrigerant leaving the evaporator 114 via the liquid heat exchanger 175, resulting in increased subcooling of the warm liquid prior to entering the evaporator expansion device 120. The warm liquid is expanded by the evaporator expansion device 120 to generate a cold mixed phase refrigerant that absorbs heat and is vaporized in the evaporator 114 to provide cooling. The cold vapor refrigerant leaves the evaporator 114 and is directed by valve V2 124 to the TES-LSHX 116 where it transfers cooling to (absorbs heat from) the storage media 160 and/or the warm liquid refrigerant leaving valve V1 122 via the suction heat exchanger 170. This results in increased superheat of the cold vapor refrigerant prior to entering the compressor 110. In this mode, the TES-LSHX 116 is in a discharged state and acts as a traditional LSHX (i.e., there is zero or a neutral net energy transfer to the storage media 160).

In discharge mode of the system of FIG. 2, all basic AC/R components are active including the compressor 110, condenser 112, evaporator expansion device 120, and the evaporator 114. In addition, the TES-LSHX 116 transfers energy from the warm liquid supply line to the storage media 160 and the cold vapor suction line through direct heat exchange in the liquid heat exchanger 175. Valve V1 122 directs warm liquid refrigerant leaving the condenser 112, after being compressed by the compressor 110, to the TES-LSHX 116 where it rejects heat to the storage media 160 and/or the cold vapor refrigerant leaving the evaporator 114 via the liquid heat exchanger 175. This results in increased subcooling of the warm liquid prior to entering the evaporator expansion device 120. The warm liquid is expanded by the evaporator expansion device 120 to generate a cold mixed phase refrigerant that absorbs heat and is vaporized in the evaporator 114 to provide cooling. The cold vapor refrigerant leaves the evaporator 114 and is directed by valve V2 124 to the TES-LSHX 116 where it transfers cooling to (absorbs heat from) the storage media 160 and/or the warm liquid refrigerant leaving valve V1 122 via the suction heat exchanger 170. This results in increased superheat of the cold vapor refrigerant prior to entering the compressor 110. In this mode, there is a net energy addition to the storage media 160.

In LSHX isolated mode, all basic AC/R components of the system of FIG. 2 are active, including the compressor 110, condenser 112, evaporator expansion device 120, and the evaporator 114. The TES-LSHX 116 is isolated from the AC/R circuit and is inactive. Valve V1 122 directs warm liquid refrigerant leaving the condenser 112, after being compressed by the compressor 110, to the evaporator expansion device 120, bypassing the TES-LSHX 116. The warm liquid is expanded by the evaporator expansion device 120 to generate a cold mixed phase refrigerant that absorbs heat and is vaporized in the evaporator 114 to provide cooling. The cold vapor refrigerant leaves the evaporator 114 and is directed by valve V2 124 to the compressor 110, bypassing the TES-LSHX 116. In this mode, the TES-LSHX 116 is isolated from the AC/R circuit and inactive, allowing the AC/R system to operate traditionally (no TES-LSHX or LSHX operation) if desired.

In subcooling only discharge mode, all basic AC/R components of the system of FIG. 2 are active, including the compressor 110, condenser 112, evaporator expansion device 120, and the evaporator 114. In addition, the TES-LSHX 116 transfers energy from the warm liquid supply line to the storage media 160. Valve V1 122 directs warm liquid refrigerant leaving the condenser 112, after being compressed by the compressor 110, to the TES-LSHX 116 where it rejects heat to the storage media 160 via liquid heat exchanger 175, resulting in increased subcooling of the warm liquid prior to entering the evaporator expansion device 120. The warm liquid is expanded by the evaporator expansion device 120 to generate a cold mixed-phase refrigerant that transfers cooling (absorbs heat) and is vaporized in the evaporator 114 to provide cooling. The cold vapor refrigerant leaves the evaporator 114 and is directed by valve V2 124 to the compressor 110, bypassing the TES-LSHX 116. In this mode, there is a net energy addition to the storage media 160.

Figure 3:
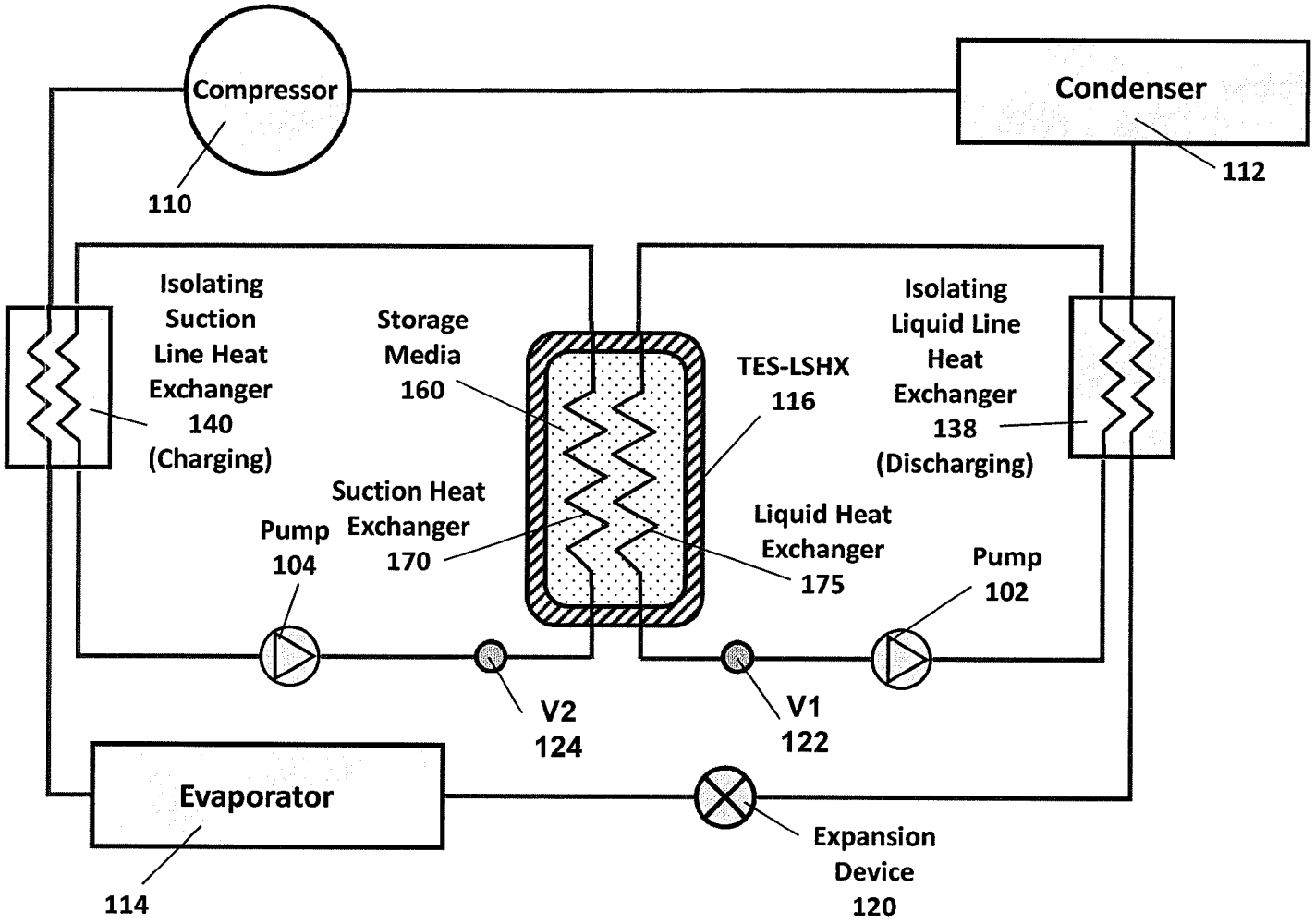
FIG. 3 schematically illustrates an embodiment of an isolated thermal energy storage liquid-suction heat exchanger.

FIG. 3 illustrates yet another embodiment of a TES-LSHX for AC/R applications. As illustrated in FIG. 3, the addition of isolation to the TES-LSHX affords additional versatility and provides additional modes that may be utilized in the system as shown, to provide cooling in various conventional or non-conventional AC/R applications and utilized with an integrated condenser/compressor/evaporator as either a retrofit to an existing system or a completely integrated new install. In this embodiment, five primary modes of operation are attainable with the system as shown: LSHX mode, charge mode, discharge mode, LSHX isolated mode and subcooling only discharge mode.

In charge mode of the system of FIG. 3, all basic AC/R components are active including the compressor 110, condenser 112, evaporator expansion device 120, and the evaporator 114. In addition, the TES-LSHX 116 (storage module) rejects heat from the storage media 160 to the cold vapor return line through an isolated circuit. The heat exchange process that occurs in the isolating suction line heat exchanger 140 between the AC/R circuit refrigerant and the suction line secondary circuit refrigerant, results in increased superheat in the cold vapor refrigerant leaving the evaporator 114 prior to entering the compressor 110. Valve V1 122 is in a "closed" state preventing cold liquid refrigerant from flowing from the TES-LSHX 116 to the isolating liquid line heat exchanger 138. Cold vapor refrigerant in the isolating suction line heat exchanger 140, rejects heat to the cold vapor leaving the evaporator 114 and condenses. The cold liquid refrigerant in the isolating suction line heat exchanger 140 flows to the TES-LSHX 116 via refrigerant pump 104 and valve V2 124, which is in the "open" state, where it absorbs heat from the storage media 160 via the suction heat exchanger 170 and vaporizes. The vapor generated in the suction heat exchanger 170 flows back to the isolating suction line heat exchanger 140 to repeat the process. In the charge mode, there is a net energy removal from the storage media 160. The refrigerant pumps 102, 104 in this configuration are optional. An alternative motive force for secondary circuit refrigerant movement is a gravity assisted thermosiphon. Valve V2 124 is also optional in this configuration.

The system of FIG. 3, when in LSHX mode, operates with all basic AC/R components active, including the compressor 110, condenser 112, evaporator expansion device 120, and the evaporator 114. In addition, the TES-LSHX 116 transfers energy from the warm liquid supply line of the AC/R circuit to the cold vapor suction line of the AC/R circuit through multiple isolated circuits. The heat exchange processes that occur in the isolating heat exchangers 138 and 140, between the AC/R circuit refrigerant, the liquid line secondary circuit refrigerant, and the suction line secondary circuit refrigerant, result in increased subcooling of the warm liquid refrigerant leaving the condenser 112, after being compressed by the compressor 110, prior to entering the evaporator expansion device 120. This also results in an increased superheat in the cold vapor refrigerant leaving the evaporator 114 prior to entering the compressor 110. Valve V1 122 is in an "open" state allowing cold liquid refrigerant to flow from the TES-LSHX 116 to the isolating liquid line heat exchanger 138, via refrigerant pump 102. The liquid refrigerant in the secondary circuit absorbs heat from the warm liquid refrigerant leaving the condenser 112, after being compressed by the compressor 110, via the isolating liquid line heat exchanger 138, and vaporizes.

The cold vapor refrigerant in the liquid line secondary circuit leaves the isolating liquid line heat exchanger 138 and returns to the TES-LSHX 116, where it rejects heat to the storage media 160 and/or the cold liquid refrigerant in the suction line secondary circuit via the liquid heat exchanger 175, and condenses. Cold vapor refrigerant in the suction line secondary circuit of the suction heat exchanger 170 leaves the TES-LSHX 116 and enters the isolating suction line heat exchanger 140. Here, heat is rejected to the cold vapor refrigerant leaving the evaporator 114 via the isolating suction line heat exchanger 140, and condenses. The cold liquid refrigerant in the isolating suction line heat exchanger 140 returns to the TES-LSHX 116 via refrigerant pump 104 and valve V2 124, which is in the "open" state, where the refrigerant transfers cooling to (absorbs heat from) the storage media 160 and/or the vapor refrigerant in the liquid line secondary circuit via the suction heat exchanger 170, and vaporizes. In this mode, the TES-LSHX 116 acts as a traditional LSHX. In this mode, there is zero or a neutral net energy transfer to the storage media 160. The refrigerant pumps 102, 104 in this configuration are also optional, with alternative motive force being gravity assisted thermosiphon. Valve V2 124 is also optional in this configuration.

The system of FIG. 3, when in discharge mode, operates with all basic AC/R components active, including the compressor 110, condenser 112, evaporator expansion device 120, and the evaporator 114. In addition, the TES-LSHX 116 transfers energy from the warm liquid supply line of the AC/R circuit to the storage media 160, and the cold vapor suction line of the AC/R circuit through multiple isolated circuits. The heat exchange processes that occur in the isolating heat exchangers 138 and 140, between the AC/R circuit refrigerant, the liquid line secondary circuit refrigerant, and the suction line secondary circuit refrigerant, result in increased subcooling of the warm liquid refrigerant leaving the condenser 112, after being compressed by the compressor 110, prior to entering the evaporator expansion device 120, and increased superheat in the cold vapor refrigerant leaving the evaporator 114, prior to entering the compressor 110. Valve V1 122 is in an "open" state allowing cold liquid refrigerant to flow from the TES-LSHX 116 to the isolating liquid line heat exchanger 138, via refrigerant pump 102.

The liquid refrigerant in the secondary circuit, transfers cooling to (absorbs heat from) the warm liquid refrigerant leaving the condenser 112 via the isolating liquid line heat exchanger 138, and vaporizes. The cold vapor refrigerant in the liquid line secondary circuit, leaves the isolating liquid line heat exchanger 138, and returns to the TES-LSHX 116. Here, the refrigerant rejects heat to the storage media 160 and/or the cold liquid refrigerant in the suction line secondary circuit via the liquid heat exchanger 175, and condenses. Cold vapor refrigerant in the suction line secondary circuit of the suction heat exchanger 170, leaves the TES-LSHX 116 and enters the isolating suction line heat exchanger 140. Here, the refrigerant rejects heat to the cold vapor refrigerant leaving the evaporator 114, via the isolating suction line heat exchanger 140, and condenses. The cold liquid refrigerant in the isolating suction line heat exchanger 140, returns to the TES-LSHX 116 via refrigerant pump 104 and valve V2 124 (which is in the "open" state) where it transfers cooling to (absorbs heat from) the storage media 160, and/or the vapor refrigerant in the liquid line secondary circuit via the suction heat exchanger 170, and vaporizes. In this mode, there is a net energy addition to the storage media 160. The refrigerant pumps 102, 104 in this configuration once again are optional, as is valve V2 124.

In LSHX isolated mode, all basic AC/R components of the system of FIG. 3 are active, including the compressor 110, condenser 112, evaporator expansion device 120, and the evaporator 114. In this mode, the TES-LSHX 116 is inactive, valve V1 122 is in a "closed" state, and refrigerant pump 102 is inactive. This prevents liquid refrigerant from leaving the TES-LSHX 116 and absorbing heat from the warm liquid refrigerant leaving the condenser 112 via the isolating liquid line heat exchanger 138. Valve V2 124 is in a "closed" state, and refrigerant pump 104 is inactive. This prevents cold liquid refrigerant in the isolating suction line heat exchanger 140 from returning to the TES-LSHX 116, and absorbing heat from the storage media 160, via the suction heat exchanger 170. In this mode, the TES-LSHX 116 is inactive, allowing the AC/R system to operate traditionally (no TES-LSHX or LSHX operation). The refrigerant pumps in this configuration once again are optional.

In subcooling only discharge mode, all basic AC/R components of the system of FIG. 3 are active, including the compressor 110, condenser 112, evaporator expansion device 120, and the evaporator 114. In addition, the TES-LSHX 116 transfers energy from the warm liquid supply line, to the storage media 160, through an isolated circuit. The heat exchange process that occurs in the isolating liquid line heat exchanger 138, between the AC/R circuit refrigerant and the liquid line secondary circuit refrigerant, results in increased subcooling of the warm liquid refrigerant leaving the condenser 112 prior to entering the evaporator expansion device 120. Valve V1 122 is in an "open" state, which allows cold liquid refrigerant to flow from the TES-LSHX 116, to the isolating liquid line heat exchanger 138, via refrigerant pump 102. The liquid refrigerant in the secondary circuit, absorbs heat from the warm liquid refrigerant leaving the condenser 112, after being compressed by the compressor 110, via the isolating liquid line heat exchanger 138, and vaporizes. The cold vapor refrigerant in the liquid line secondary circuit leaves the isolating liquid line heat exchanger 138, and returns to the TES-LSHX 116. Here, the refrigerant rejects heat to the storage media 160 via the liquid heat exchanger 175, and condenses. Valve V2 124 is in a "closed" state, and refrigerant pump 104 is inactive, thereby preventing cold liquid refrigerant in the isolating suction line heat exchanger 140 from returning to the TES-LSHX 116, and absorbing heat from the storage media 160 via, the suction heat exchanger 170. In this mode, there is a net energy addition to the storage media 160. The refrigerant pumps 102, 104 in this configuration once again are optional.

Figure 4:
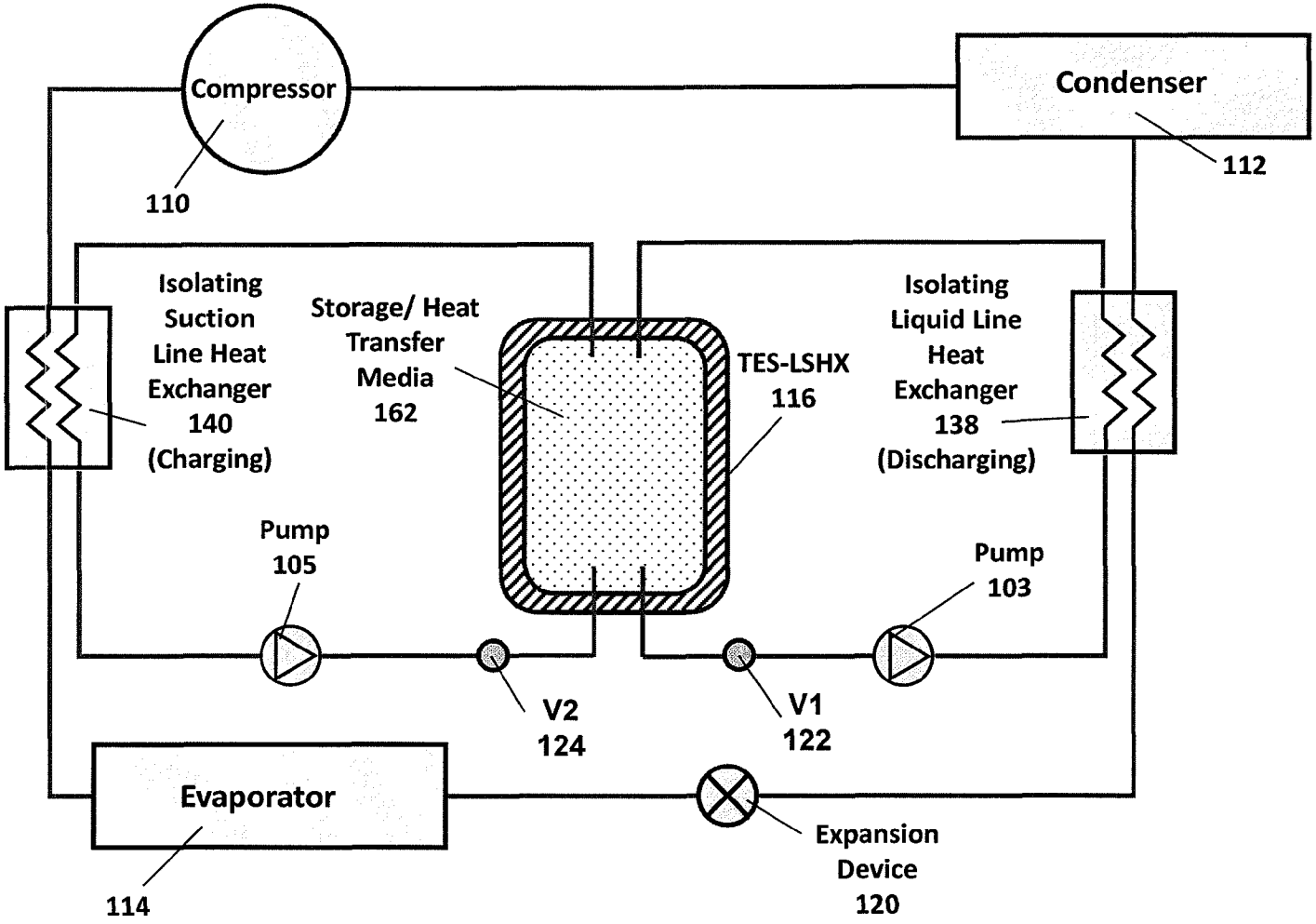
FIG. 4 vschematically illustrates another embodiment of an isolated thermal energy storage liquid-suction heat exchanger.

FIG. 4 illustrates yet another embodiment of a TES-LSHX for AC/R applications. As illustrated in FIG. 4, the addition of isolation to the TES-LSHX affords additional versatility and provides additional modes that may be utilized in the system as shown, to provide cooling in various conventional or non-conventional AC/R applications and utilized with an integrated condenser/compressor/evaporator as either a retrofit to an existing system or a completely integrated new install. In this embodiment the TES-LSHX utilizes a storage/heat transfer media 162 that acts to store thermal capacity as well as transport this capacity (heating and/or cooling) to the primary AC/R circuit. This storage/heat transfer media 162 may be brine, glycol, ice slurry, encapsulated storage with liquid, or any other type or combination that facilitates storage and transport of thermal energy. Five primary modes of operation are attainable with the system as shown: LSHX mode, charge mode, discharge mode, LSHX isolated mode and subcooling only discharge mode.

In charge mode of the system of FIG. 4, all basic AC/R components are active including the compressor 110, condenser 112, evaporator expansion device 120, and the evaporator 114. In addition, the TES-LSHX 116 (storage module) rejects heat from the storage/heat transfer media 162 to the cold vapor return line by directly circulating the storage media through the isolating heat exchanger in communication with the refrigerant loop. The heat exchange process that occurs in the isolating suction line heat exchanger 140 between the AC/R circuit refrigerant and the suction line secondary circuit, results in increased superheat in the cold vapor refrigerant leaving the evaporator 114 prior to entering the compressor 110.

Valve V1 122 is in a "closed" state preventing storage/heat transfer media 162 from flowing from the TES-LSHX 116 to the isolating liquid line heat exchanger 138. Cold storage/heat transfer media 162 in the isolating suction line heat exchanger 140 rejects heat to the cold vapor leaving the evaporator 114. The cold storage/heat transfer media 162 in the isolating suction line heat exchanger 140 flows to the TES-LSHX 116 via pump 105 and valve V2 124, which is in the "open" state, where it absorbs heat from additional storage/heat transfer media 162. The storage/heat transfer media 162 flows back to the isolating suction line heat exchanger 140 to repeat the process. In the charge mode, there is a net energy removal from the storage/heat transfer media 162. The pumps 103, 105 in this configuration are optional. An alternative motive force for secondary circuit media movement is a gravity assisted thermosiphon. Valve V2 124 is also optional in this configuration.

The system of FIG. 4, when in LSHX mode, operates with all basic AC/R components active, including the compressor 110, condenser 112, evaporator expansion device 120, and the evaporator 114. In addition, the TES-LSHX 116 transfers energy from the warm liquid supply line of the AC/R circuit to the cold vapor suction line of the AC/R circuit through an isolated circuit. The heat exchange processes that occur in the isolating heat exchangers 138 and 140, between the AC/R circuit refrigerant, the liquid line secondary circuit media, and the suction line secondary circuit media, result in increased subcooling of the warm liquid refrigerant leaving the condenser 112, after being compressed by the compressor 110, prior to entering the evaporator expansion device 120. This also results in an increased superheat in the cold vapor refrigerant leaving the evaporator 114 prior to entering the compressor 110. Valve V1 122 is in an "open" state allowing cold storage/heat transfer media 162 to flow from the TES-LSHX 116 to the isolating liquid line heat exchanger 138, via pump 103. The media in the secondary circuit absorbs heat from the warm liquid refrigerant leaving the condenser 112, after being compressed by the compressor 110, via the isolating liquid line heat exchanger 138.

The warm storage/heat transfer media 162 in the liquid line secondary circuit leaves the isolating liquid line heat exchanger 138 and returns to the TES-LSHX 116, and/or the storage/heat transfer media 162 in the suction line secondary circuit. Warm storage/heat transfer media 162 in the suction line secondary circuit leaves the TES-LSHX 116 and enters the isolating suction line heat exchanger 140. Here, heat is rejected to the cold vapor refrigerant leaving the evaporator 114 via the isolating suction line heat exchanger 140. The cold storage/heat transfer media 162 in the isolating suction line heat exchanger 140 returns to the TES-LSHX 116 and/or the storage/heat transfer media 162 in the liquid line secondary circuit via pump 105 and valve V2 124, which is in the "open" state. In this mode, the TES-LSHX 116 acts as a traditional LSHX. In this mode, there is zero or a neutral net energy transfer to the storage/heat transfer media 162. The pumps 103, 105 in this configuration are also optional, with alternative motive force being gravity assisted thermosiphon. Valve V2 124 is also optional in this configuration.

The system of FIG. 4, when in discharge mode, operates with all basic AC/R components active, including the compressor 110, condenser 112, evaporator expansion device 120, and the evaporator 114. In addition, the TES-LSHX 116 transfers energy from the warm liquid supply line of the AC/R circuit to the storage/heat transfer media 162, and the cold vapor suction line of the AC/R circuit through an isolated circuit. The heat exchange processes that occur in the isolating heat exchangers 138 and 140, between the AC/R circuit refrigerant, the liquid line secondary circuit, and the suction line secondary circuit, result in increased subcooling of the warm liquid refrigerant leaving the condenser 112, after being compressed by the compressor 110, prior to entering the evaporator expansion device 120, and increased superheat in the cold vapor refrigerant leaving the evaporator 114, prior to entering the compressor 110. Valve V1 122 is in an "open" state allowing cold storage/heat transfer media 162 to flow from the TES-LSHX 116 to the isolating liquid line heat exchanger 138, via pump 103.

The storage/heat transfer media 162 in the secondary circuit, transfers cooling to (absorbs heat from) the warm liquid refrigerant leaving the condenser 112 via the isolating liquid line heat exchanger 138. The warm storage/heat transfer media 162 in the liquid line secondary circuit, leaves the isolating liquid line heat exchanger 138, and returns to the TES-LSHX 116. Warm storage/heat transfer media 162 in the TES-LSHX 116 then enters the isolating suction line heat exchanger 140. Here, the media rejects heat to the cold vapor refrigerant leaving the evaporator 114 via the isolating suction line heat exchanger 140. The cold storage/heat transfer media 162 in the isolating suction line heat exchanger 140, returns to the TES-LSHX 116 via pump 105 and valve V2 124 (which is in the "open" state) where it transfers cooling to the remaining storage/heat transfer media 162, and/or the media in the liquid line secondary circuit. In this mode, there is a net energy addition to the storage/heat transfer media 162. The pumps 103, 105 in this configuration once again are optional, as is valve V2 124.

In LSHX isolated mode, all basic AC/R components of the system of FIG. 4 are active, including the compressor 110, condenser 112, evaporator expansion device 120, and the evaporator 114. In this mode, the TES-LSHX 116 is inactive, valve V1 122 is in a "closed" state, and pump 103 is inactive. This prevents storage/heat transfer media 162 from leaving the TES-LSHX 116 and absorbing heat from the warm liquid refrigerant leaving the condenser 112 via the isolating liquid line heat exchanger 138. Valve V2 124 is in a "closed" state, and pump 105 is inactive. This prevents cold storage/heat transfer media 162 in the isolating suction line heat exchanger 140 from returning to the TES-LSHX 116. In this mode, the TES-LSHX 116 is inactive, allowing the AC/R system to operate traditionally (no TES-LSHX or LSHX operation). The pumps in this configuration once again are optional.

In subcooling only discharge mode, all basic AC/R components of the system of FIG. 4 are active, including the compressor 110, condenser 112, evaporator expansion device 120, and the evaporator 114. In addition, the TES-LSHX 116 transfers energy from the warm liquid supply line, to the storage/heat transfer media 162, through an isolated circuit. The heat exchange process that occurs in the isolating liquid line heat exchanger 138 between the AC/R circuit refrigerant and the liquid line secondary circuit media, results in increased subcooling of the warm liquid refrigerant leaving the condenser 112 prior to entering the evaporator expansion device 120. Valve V1 122 is in an "open" state, which allows cold storage/heat transfer media 162 to flow from the TES-LSHX 116, to the isolating liquid line heat exchanger 138, via pump 103. The media in the secondary circuit absorbs heat from the warm liquid refrigerant leaving the condenser 112, after being compressed by the compressor 110, via the isolating liquid line heat exchanger 138. The warm storage/heat transfer media 162 in the liquid line secondary circuit leaves the isolating liquid line heat exchanger 138, and returns to the TES-LSHX 116. Here, the media rejects heat to the remaining storage/heat transfer media 162. Valve V2 124 is in a "closed" state, and pump 105 is inactive, thereby preventing cold storage/heat transfer media 162 in the isolating suction line heat exchanger 140 from returning to the TES-LSHX 116. In this mode, there is a net energy addition to the storage/heat transfer media 162. The pumps 103, 105 in this configuration once again are optional.

The disclosed system may utilize a relatively small capacity condenser compressor (air conditioner) and have the ability to deliver high capacity cooling utilizing thermal energy storage. This variability may be further extended by specific sizing of the compressor and condenser components within the system. Whereas the aforementioned refrigerant loops have been described as having a particular direction, it is shown and contemplated that these loops may be run in either direction whenever possible. Additionally, it is contemplated that the isolated loops for the suction line heat exchanger and the liquid line heat exchanger in the embodiment of FIG. 3 may be refrigerant based or coolant based as in FIG. 4. That is, each of the loops may be phase change refrigerant such as R-22, R-410A, Butane or the like, or they may be non-phase change material such as brine, ice slurry, glycol or the like.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

The invention claimed is:

1. An integrated refrigerant-based thermal energy storage and cooling system comprising:

a refrigerant loop containing a refrigerant comprising:

a condensing unit, said condensing unit comprising a compressor and a condenser;

an expansion device connected downstream of said condensing unit;

an evaporator connected downstream of said expansion device;

a thermal energy storage module comprising:

a thermal storage media contained therein;

a liquid heat exchanger between said condenser and said expansion device, that facilitates heat transfer between a refrigerant and said thermal storage media; and, a suction heat exchanger between said evaporator and said compressor that facilitates heat transfer between said refrigerant and said thermal storage media;

a first valve that facilitates flow of refrigerant from said condenser to said thermal energy storage module or said expansion device.

2. The system of claim 1 further comprising:

a second valve that facilitates flow of refrigerant from said evaporator to said thermal energy storage module or said compressor.

3. The system of claim 1 wherein said expansion device is chosen from the group consisting of a thermostatic expansion valve, an electronic expansion valve, a static orifice, a capillary tube, and a mixed-phase regulator.

4. The system of claim 1 wherein at least a portion of said thermal storage media changes phase in said charge mode and said discharge mode.

5. The system of claim 1 wherein said thermal storage media is a eutectic material.

6. The system of claim 1 wherein said thermal storage media is water.

7. The system of claim 1 wherein said thermal storage media does not store heat in the form of latent heat.

8. The system of claim 1 wherein said evaporator is at least one mini-split evaporator.

9. An integrated refrigerant-based thermal energy storage and cooling system comprising:

a refrigerant loop containing a refrigerant comprising:

a condensing unit, said condensing unit comprising a compressor and a condenser;

an expansion device connected downstream of said condensing unit; and, an evaporator connected downstream of said expansion device;

a thermal energy storage module comprising:

a thermal storage media contained therein;

a liquid heat exchanger; and, a suction heat exchanger;

a thermal energy storage discharge loop comprising:

an isolated liquid line heat exchanger in thermal communication with said liquid heat exchanger, said isolated liquid line heat exchanger in thermal communication with said refrigeration loop between said condenser and said expansion device, said discharge loop that facilitates heat transfer between said thermal storage media and said refrigerant;

a first valve that facilitates thermal communication between said liquid heat exchanger and said isolated liquid line heat exchanger;

a thermal energy storage charge loop comprising:

an isolated suction line heat exchanger in thermal communication with said suction heat exchanger, said isolated suction line heat exchanger in thermal communication with said refrigeration loop between said evaporator and said condenser, said charge loop that facilitates heat transfer between said thermal storage media and said refrigerant;

a second valve that facilitates thermal communication between said suction heat.

10. The system of claim 9 wherein said expansion device is chosen from the group consisting of a thermostatic expansion valve, an electronic expansion valve, a static orifice, a capillary tube, and a mixed-phase regulator.

11. The system of claim 9 wherein at least a portion of said thermal storage media changes phase in said charge mode and said discharge mode.

12. The system of claim 9 wherein said thermal storage media is a eutectic material.

13. The system of claim 9 wherein said thermal storage media is water.

14. The system of claim 9 wherein said thermal storage media does not store heat in the form of latent heat.

15. The system of claim 9 wherein said evaporator is at least one mini-split evaporator.

16. The system of claim 9 wherein said thermal energy storage discharge loop transfers thermal capacity utilizing a coolant as a heat transfer medium.

17. The system of claim 9 wherein said thermal energy storage charge loop transfers thermal capacity utilizing a coolant as a heat transfer medium.

18. The system of claim 9 wherein said thermal energy storage discharge loop transfers thermal capacity utilizing a refrigerant as a heat transfer medium.

19. The system of claim 9 wherein said thermal energy storage charge loop transfers thermal capacity utilizing a refrigerant as a heat transfer medium.

20. An integrated refrigerant-based thermal energy storage and cooling system comprising:

a refrigerant loop containing a refrigerant comprising:

a condensing unit, said condensing unit comprising a compressor and a condenser;

an expansion device connected downstream of said condensing unit; and, an evaporator connected downstream of said expansion device;

a thermal energy storage module comprising:

a thermal storage and transfer media contained therein;

a thermal energy storage discharge loop comprising:

an isolated liquid line heat exchanger in thermal communication with said thermal energy storage module, said isolated liquid line heat exchanger in thermal communication with said refrigeration loop between said condenser and said expansion device, said discharge loop that facilitates heat transfer between said thermal storage and transfer media in said thermal energy storage module and said refrigerant;

a first valve that facilitates thermal communication between said thermal energy storage module and said isolated liquid line heat exchanger;

a thermal energy storage charge loop comprising:

an isolated suction line heat exchanger in thermal communication with said thermal energy storage module, said isolated suction line heat exchanger in thermal communication with said refrigeration loop between said evaporator and said condenser, said charge loop that facilitates heat transfer between said thermal storage and transfer media in said thermal energy storage module and said refrigerant;

a second valve that facilitates thermal communication between said thermal energy storage module and said isolated liquid suction heat exchanger.

21. The system of claim 20 wherein said expansion device is chosen from the group consisting of a thermostatic expansion valve, an electronic expansion valve, a static orifice, a capillary tube, and a mixed-phase regulator.

22. The system of claim 20 wherein said thermal storage and transfer media is glycol.

23. The system of claim 20 wherein said thermal storage and transfer media is brine.

24. The system of claim 20 wherein said evaporator is at least one mini-split evaporator.

25. An integrated refrigerant-based thermal energy storage and cooling system comprising:

a refrigerant loop containing a refrigerant comprising:

a means for compressing and condensing a refrigerant with a compressor and a condenser to create a high-pressure refrigerant;

during a first time period:

a means for expanding said high-pressure refrigerant with an expansion device to produce expanded refrigerant and provide load cooling with an evaporator;

a means for transferring cooling from said expanded refrigerant downstream of said evaporator to a thermal energy storage media within a thermal energy storage module via an isolated suction line heat exchanger; and, a means for returning said expanded refrigerant to said compressor;

during a second time period:

a means for subcooling said high-pressure refrigerant downstream of said condenser with said thermal energy storage media via an isolated liquid line heat exchanger;

a means for expanding said subcooled refrigerant with said expansion device to produce expanded refrigerant and provide load cooling with said evaporator;

a means for transferring cooling from said expanded refrigerant downstream of said evaporator to said thermal energy storage media via said isolated suction line heat exchanger; and, a means for returning said expanded refrigerant to said compressor;

during a third time period:

a means for subcooling said high-pressure refrigerant downstream of said condenser with said thermal energy storage media via an isolated liquid line heat exchanger;

a means for expanding said subcooled refrigerant with said expansion device to produce expanded refrigerant and provide load cooling with said evaporator; and, a means for returning said expanded refrigerant to said compressor.

* * * * *